United States Patent [19]

Roemer

[11] Patent Number: 4,840,237

[45] Date of Patent: Jun. 20, 1989

[54] RAM BORING IMPLEMENT

[76] Inventor: Helmuth Roemer, Attendorner Strasse 135, D-5950 Finnentrop-Haggen, Fed. Rep. of Germany

[21] Appl. No.: 151,421

[22] Filed: Jan. 4, 1988

[30] Foreign Application Priority Data

Jan. 2, 1987 [DE] Fed. Rep. of Germany ... 8700076[U]

[51] Int. Cl.[4] ..... E21B 4/14

[52] U.S. Cl. ..... 175/19; 173/91; 175/92; 175/296

[58] Field of Search ..... 175/19, 92, 296; 173/91, 135, 138

[56] References Cited

U.S. PATENT DOCUMENTS

| | | | |
|---|---|---|---|
| 3,551,874 | 3/1972 | Sudnishnikov et al. | 175/19 X |
| 3,616,865 | 11/1971 | Sudnoshnikov et al. | 173/137 X |
| 3,995,702 | 12/1976 | Klimashko et al. | 173/91 |
| 4,609,052 | 9/1986 | Lewin | 175/19 X |
| 4,618,007 | 10/1986 | Kayes | 175/19 |

FOREIGN PATENT DOCUMENTS

| | | |
|---|---|---|
| 1634417 | 3/1971 | Fed. Rep. of Germany . |
| 2157259 | 6/1973 | Fed. Rep. of Germany . |

*Primary Examiner*—Hoang C. Dang

*Attorney, Agent, or Firm*—Foley & Lardner, Schwartz, Jeffery, Schwaab, Mack, Blumenthal & Evans

[57] ABSTRACT

A ram boring implement has a pneumatically driven percussion piston (16), which is movable in the axial direction in a reciprocating manner in a housing (12), and a control sleeve (24) which is axially adjustable for reversing the direction of motion of the ram boring implement and is acted upon by the pressure in one (20) of the pressure chambers (18, 20) formed on both sides of the percussion piston (16). The control sleeve (24) can be adjusted by means of a spindle drive (30, 50) by turning a compressed air supply hose (26). According to the invention, the control sleeve is arranged on a core (30, 34), supported in an axially fixed manner on the housing (12), so that the control sleeve itself forms only a relatively small annular effective area (52) acted upon by pressure. This makes it possible for the control sleeve to be moved forward or toward the rear without the compressed air feed having to be interrupted.

12 Claims, 2 Drawing Sheets

RAM BORING IMPLEMENT

BACKGROUND OF THE INVENTION

The present invention relates to a ram boring implement having a pneumatically driven percussion piston, which is movable in the axial direction in a reciprocating manner in a housing, a control sleeve, which is axially adjustable for reversing the direction of motion of the ram boring implement and is acted upon by the pressure in one of the pressure chambers formed on both sides of the percussion piston, and a spindle drive with which the control sleeve can be adjusted by turning a compressed air supply hose. Ram boring implements of this type are used for driving earth bores for cables and the like that are laid underground.

German Pat. No. 1,634,417 discloses a ram boring implement of this generic type. The percussion piston has a tubular section displaceable on the control sleeve and, in the peripheral wall of this tubular section, is provided with radial channels which are periodically opened and closed by the control sleeve during the oscillating motion of the percussion piston. The compressed air feed to the pressure chamber for driving the percussion piston is controlled in this way. If the control sleeve is located in a front position, the percussion piston, during its forward stroke, strikes against the front end of the housing so that impulse is transmitted to the housing and the ram boring implement is driven in the forward direction. If the control sleeve is located in the rear position, the motion of the percussion piston is pneumatically braked during the forward stroke before the percussion piston reaches the front end of the housing. Instead, the percussion piston in this case strikes against the rear end of the housing during its rearward stroke, so that the ram boring implement moves in the rearward direction.

In the conventional implement, the control sleeve is rigidly connected to the compressed air supply hose. The spindle drive for adjusting the control sleeve is formed by an external thread which is made on the control sleeve and is engaged with a component rigidly connected to the housing.

The pressure chamber located on the rearside of the percussion piston is made in the tubular section of the percussion piston and is defined toward the rear by the control sleeve made in a pot shape. When this pressure chamber is pressurized during the forward stroke of the percussion piston, a relatively large force directed toward the rear therefore acts on the control sleeve. For this reason, changing over from the rearward motion to the forward motion by axially adjusting the control sleeve forward can only take place when the compressed air feed is switched off. The thread of the spindle drive may only have a small pitch in order that the relatively large axial forces can be reliably absorbed. When the direction of motion of the ram boring implement is to be reversed and the compressed air hose is turned manually for this purpose, the compressed air hose must execute a large number of revolutions, as a result of which the reversal of the direction of motion is relatively laborious and time-consuming.

SUMMARY OF THE INVENTION

It is therefore an object of the present invention to provide an improved ram boring implement of the generic type mentioned at the outset.

It is also an object of the present invention to provide a ram boring implement wherein the direction of motion can be reversed quickly and reliably.

A further object of the invention is to provide a ram boring implement in which the reversal of the direction of motion can be executed when the ram boring implement is running, i.e., when the compressed air feed is switched on.

In accomplishing these objects, there has been provided in accordance with the present invention a ram boring implement, comprising a generally cylindrical housing; a pneumatically driven percussion piston axially movable in a reciprocating manner in the housing and defining a first pressure chamber in front of it and a second pressure chamber behind it; a core member fixed axially within the housing; a compressed air supply, comprising a compressed air supply hose connected to the housing; a control sleeve which is axially adjustable for reversing the direction of motion of the ram boring implement, this control sleeve being arranged on the core member and including an annular effective area that is acted upon by the pressure in the second pressure chamber; and means, including a spindle drive for axially adjusting the control sleeve in response to turning of the compressed air supply hose.

Further objects, features and advantages of the invention will become apparent from the detailed description of preferred embodiments that follows, when considered in light of the accompanying figures of drawing.

BRIEF DESCRIPTIONS OF THE DRAWINGS

DETAILED DESCRIPTION OF PREFERRED EMBODIMENTS

Figure 1:
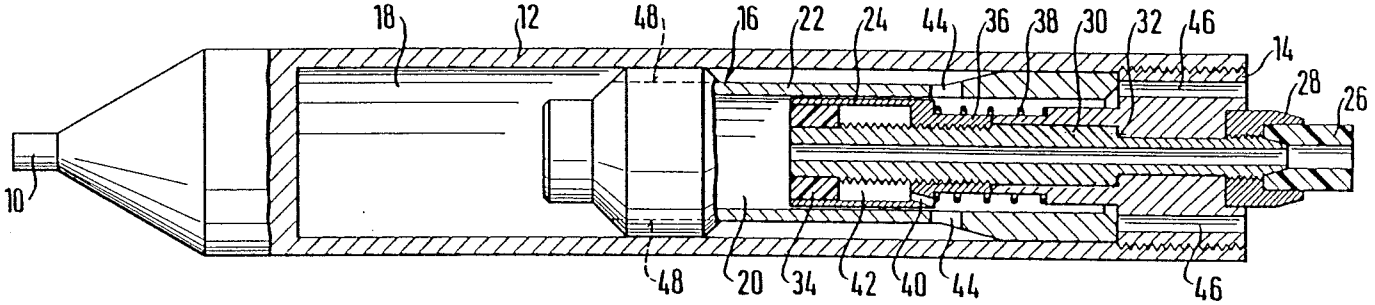
FIG. 1 is a partial cross-sectional view taken through a ram boring implement according to the invention with a control sleeve set for driving in the rearward direction.

According to the invention, the control sleeve is arranged on a core, which is supported in an axially fixed manner on the housing, and forms an annular effective area acted upon by pressure.

By means of the core supported on the housing, the effective area of the control sleeve to be acted upon by compressed air during the forward stroke of the percussion piston is considerably reduced, so that the control sleeve only needs to absorb correspondingly low axial forces. These low axial forces can be effortlessly overcome during the adjustment of the control sleeve so that the control sleeve can be adjusted without problem even when the ram boring implement is running. Since the axial forces are only small, the spindle drive can have a relatively large thread pitch without the control sleeve moving automatically when the implement is running. During the reversal of direction, the compressed air hose therefore only needs to be turned by a few revolutions or not even by one complete revolution.

A ram boring implement has already been disclosed in German Pat. No. 2,157,259 in which the control sleeve is arranged on an axially fixed core and only has one annular area acted upon by pressure. However, the direction is not reversed here by means of a spindle drive but directly by axial displacement of the control sleeve by means of the compressed air hose. During the forward motion of the ram boring implement, the control sleeve is arrested in the front position by means of a locking device. To change over to the rearward motion, the locking device is released by means of a cable line. In this implement, the effective area of the control sleeve is of such a large size that the control sleeve is displaced pneumatically toward the rear after the locking device is released. If a changeover to forward motion is again to be made, the compressed air feed has to be interrupted so that the control sleeve can again be pushed forward and locked. In this known implement, the principle according to the invention of reducing the effective area of the control sleeve in such a way that it can be moved forward against the working pressure is therefore not realized.

Advantageous developments of the ram boring implement according to the invention as well as a preferred exemplary embodiment of the invention are described in greater detail below with reference to the drawings.

A ram boring implement has a housing 12 which is provided with a percussion tip 10 and is closed at the rear end by an end piece 14. Inside the housing 12, a front pressure chamber 18 and a rear pressure chamber 20 are formed by a percussion piston 16 guided in an axially movable manner in the housing. The rear pressure chamber 20 is located in a tubular section 22 of the percussion piston 16 which is displaceable in a sliding manner on a control sleeve 24. A compressed air hose 26 for supplying the ram boring implement with compressed air is connected non-rotationally via a connection piece 28 to a control tube 30 which is rotatably mounted in the end piece 14 and is supported in the axial direction on a shoulder 32 of the end piece. At the front end, the control tube 30 is surrounded by an elastomeric cushioning element 34 which is in tight contact with the inner wall of a thin-walled cylindrical section of the control sleeve 24. The rear pressure chamber 20 is therefore defined toward the rear by the control tube 30, the cushioning element 34 and the thin-walled cylindrical section of the control sleeve 24. A rear section 36 of the control sleeve is in screw-thread engagement with the control tube 30. The control sleeve 24 is preloaded toward the front by a right-hand helical compression spring 38 supported on the end piece 14 and has ventilation channels 40 for ventilating the hollow space 42, defined by the cushioning element 34, inside the control sleeve.

The tubular section 22 of the percussion piston 16 is provided with radial channels 44, and the end piece 14 has axial air channels 46 which are fluidly connected to the inside of the tubular section 22 of the percussion piston.

In the position of the percussion piston shown in FIG. 1, the front pressure chamber 18 is relieved of pressure via axial channels 48 of the control piston, via the radial channels 44 and the axial channels 46 of the end piece 14. When compressed air is introduced into the rear pressure chamber 20 via the compressed air hose 26 and the control tube 30, the percussion piston 16 moves toward the front. The radial channels 44 are temporarily closed by the control sleeve 24 and then come into fluid connection with the rear pressure chamber 20, so that the compressed air expands into the front pressure chamber 18 via the radial channels 44 and the axial channels 48. Since the effective area of the percussion piston 16 relative to the front pressure chamber 18 is greater than relative to the rear pressure chamber 20, the piston is braked and moved back again so that it does not strike against the front end of the housing 12. At the end of its rearward stroke, the percussion piston 16 strikes against the rear end piece 14 of the housing and imparts a rearward impulse to the housing. The actions described above are repeated periodically so that the ram boring implement is on the whole driven in the rearward direction.

Figure 2:
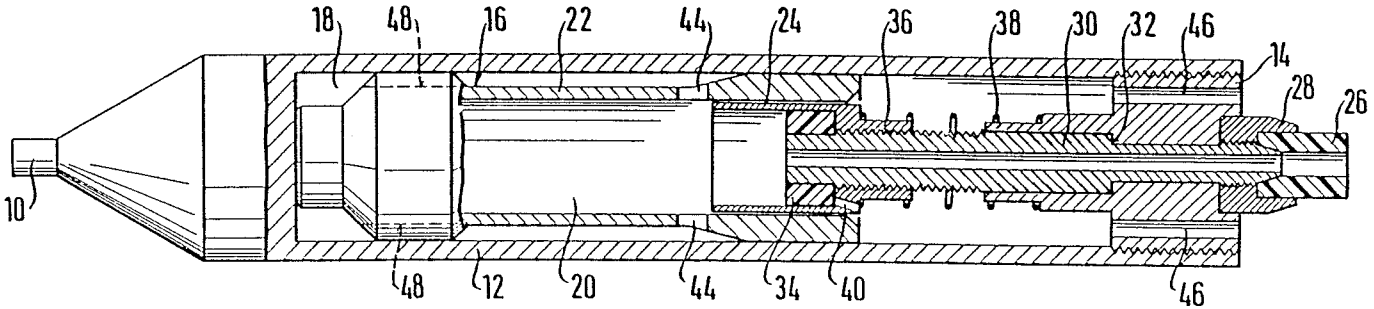
FIG. 2 is a partial cross-sectional view taken through the ram boring implement with a control sleeve set for driving in the forward direction.

On the other hand, if the control sleeve is located in the front position shown in FIG. 2, the percussion piston, during its forward stroke, strikes against the front end of the housing 12 and, during the rearward stroke, the percussion piston is pneumatically braked before it reaches the end piece 14. In this case, therefore, the ram boring implement is driven in the forward direction.

Figure 3:
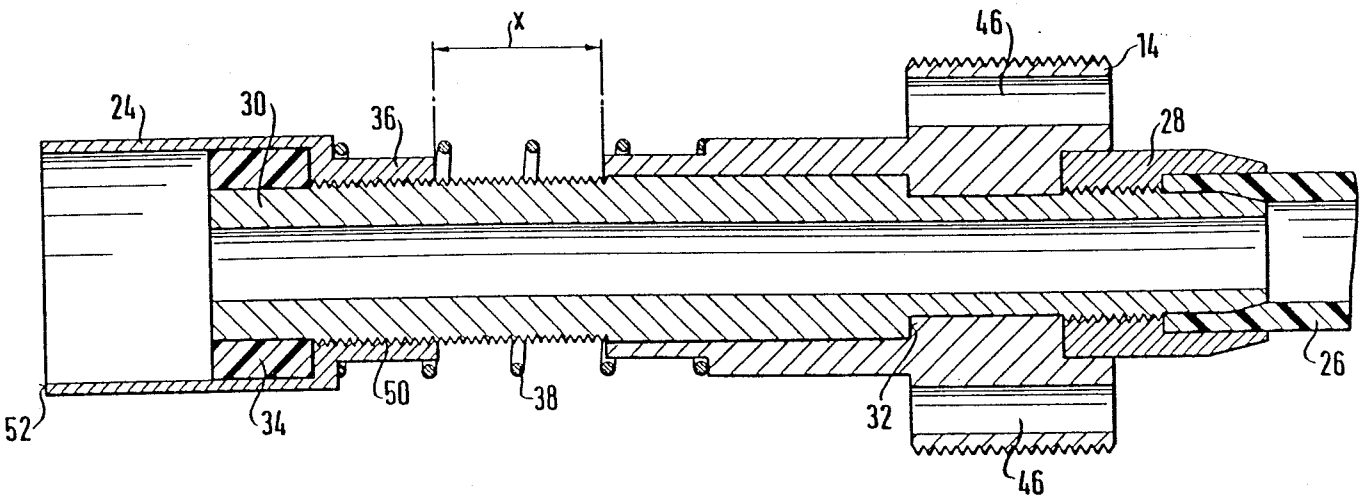
FIG. 3 is an enlarged cross-sectional view taken through parts of the ram boring implement.

During the reversal of the direction of motion, the control sleeve 24 is adjusted by the compressed air hose 26 being turned, for example, manually. The thread 50 of the rear section 36 of the control sleeve and of the control tube 30 is, for example, a four-start thread with an axial thread spacing of 10 mm. The pitch of an individual thread turn is therefore 40 mm so that the control sleeve, can be moved the entire displacement distance "x" (FIG. 3) by means of only one to three revolutions. Since the effective area of the control sleeve 24 facing the pressure chamber 20 is only very small, when the ram boring implement is running, the control sleeve can be moved forward against the pressure prevailing in the pressure chamber 20. The helical compression spring 38 assists the forward motion of the control sleeve and at the same time forms an anti-rotation means which prevents the control sleeve from turning when the control tube 30 turns. Alternatively, however, another anti-rotation means can be additionally provided.

If a high pressure prevails in the pressure chamber 20, a relatively low axial force acts on the control sleeve 24, which force, on account of the action of the thread, tends to turn the control tube 30. At the same time, however, a substantially larger axial force acts directly on the control tube 30 so that rotation of the control tube is prevented on account of the friction between the control tube and the shoulder 32. In this way, despite the relatively large thread pitch, the control sleeve 24 is held in a self-locking manner in the respective position.

What is claimed is:

1. A ram boring implement, comprising:

a generally cylindrical housing;

a pneumatically driven percussion piston axially movable in a reciprocating manner in the housing and defining a first pressure chamber in front of it and a second pressure chamber behind it;

a core member mounted axially within said housing;

said core member having an end portion coaxially projecting into the interior of said housing;

a compressed air supply, comprising a compressed air supply hose connected to the housing; and a control sleeve which is axially adjustable for reversing the direction of motion of the ram boring implement, said control sleeve being arranged on an outer circumferential surface of said end portion and including an annular effective area that is acted upon by the pressure in the second pressure chamber;

said core member including a spindle drive rotatably mounted in said housing for adjusting the axial position of the control sleeve in response to turning of the compressed air supply hose;

said spindle drive having a first end connected to said compressed air hose for rotation therewith and a second end threadedly connected to said control sleeve to adjust the axial position of the control sleeve relative to the spindle drive while the ram boring implement is in operation.

2. A ram boring implement as claimed in claim 1, including means for non-rotationally holding the control sleeve with respect to the housing, and wherein the spindle drive comprises a part of the core member which is rotatable with respect to the housing.

3. A ram boring implement as claimed in claim 2, wherein said holding means comprises a helical compression spring supported on a rear part of the housing, said spring biasing the control sleeve in the direction of the second pressure chamber.

4. A ram boring implement as claimed in claim 2, wherein the core member comprises a control tube connected to the compressed air supply hose, and an elastic cushioning element arranged on a free end of the spindle drive and resting against the inner surface of the control sleeve so that the pressure in the second pressure chamber acts upon end surfaces of said spindle drive, said elastic cushioning element and said annular effective area.

5. A ram boring implement as claimed in claim 1, wherein the spindle drive has a thread pitch which is sufficient to hold the control sleeve in a self-locking manner against the pressure acting on the effective area of the control sleeve.

6. A ram boring implement as claimed in claim 5, wherein the pitch of the spindle drive is at least about 5 mm.

7. A ram boring implement as claimed in claim 6, wherein the threaded on the spindle drive comprises a multi-start thread.

8. A ram boring implement as claimed in claim 7, wherein the thread comprises a four-start thread.

9. A ram boring implement as claimed in claim 7, wherein the pitch of each individual thread turn is from about 20 to 40 mm.

10. A ram boring implement, comprising:

a generally cylindrical housing;

a pneumatically driven percussion piston axially movable in a reciprocating manner in the housing and defining a first pressure chamber in front of it and a second pressure chamber behind it;

a core member mounted axially within said housing;

said core member having an end portion coaxially projecting into the interior of said housing;

a compressed air supply, comprising a compressed air supply hose connected to the housing; and means for reversing the direction of motion of the ram boring implement while it is in operation, said reversing means comprising an axially adjustable control sleeve arranged on an outer circumferential surface of said end portion and including an annular effective area that is acted upon by the pressure in the second pressure chamber, and means, including a spindle drive rotatably mounted in said housing, for adjusting the axial position of the control sleeve in response to turning of the compressed air supply hose;

said spindle drive having a first end connected to said compressed air hose for rotation therewith and a second end threadedly connected to said control sleeve to adjust the axial position of the control sleeve relative to the spindle drive.

11. A ram boring implement as claimed in claim 10, including means for non-rotationally holding the control sleeve with respect to the housing, and wherein the spindle drive comprises a part of the core member which is rotatable with respect to the housing.

12. A ram boring implement as claimed in claim 11, wherein the core member comprises a control tube connected to the compressed air supply hose, and an elastic cushioning element arranged on a free end of the spindle drive and resting against the inner surface of the control sleeve so that the pressure in the second pressure chamber acts upon end surfaces of said spindle drive, said elastic cushioning element and said annular effective area.

* * * * *